US011261864B2

(12) United States Patent
Moon et al.

(10) Patent No.: US 11,261,864 B2
(45) Date of Patent: Mar. 1, 2022

(54) SCROLL COMPRESSOR WITH BUFFER MEMBER BETWEEN THE ORBITING GROOVE AND THE BALANCE WEIGHT

(71) Applicant: Hanon Systems, Daejeon (KR)

(72) Inventors: Chi Myeong Moon, Daejeon (KR); Chang Eon Park, Daejeon (KR); In Cheol Shin, Daejeon (KR); Hyun Seong Ahn, Daejeon (KR); Kweon Soo Lim, Daejeon (KR)

(73) Assignee: Hanon Systems, Daejeon (KR)

( * ) Notice: Subject to any disclaimer, the term of this patent is extended or adjusted under 35 U.S.C. 154(b) by 252 days.

(21) Appl. No.: 16/513,841

(22) Filed: Jul. 17, 2019

(65) Prior Publication Data

US 2020/0025197 A1 Jan. 23, 2020

(30) Foreign Application Priority Data

Jul. 18, 2018 (KR) ..... 10-2018-0083435

(51) Int. Cl.
*F04C 18/02* (2006.01)
*F04C 29/00* (2006.01)

(52) U.S. Cl.
CPC ..... *F04C 18/0215* (2013.01); *F04C 29/0021* (2013.01); *F04C 2240/807* (2013.01)

(58) Field of Classification Search
CPC ..... F04C 18/0215; F04C 2240/807; F04C 29/0021
See application file for complete search history.

(56) References Cited

U.S. PATENT DOCUMENTS 6,227,831 B1 * 5/2001 Osima ..... F04C 18/0215 184/6.16
6,506,036 B2 * 1/2003 Tsubai ..... F04C 23/008 417/369
9,670,927 B2 * 6/2017 Kii ..... F04C 18/0215
2015/0198161 A1 * 7/2015 Tozawa ..... F04C 29/0021 418/55.3

FOREIGN PATENT DOCUMENTS

CN 104033384 A 9/2014
JP 2012-67602 A 4/2012

* cited by examiner

*Primary Examiner* — Mary Davis
(74) *Attorney, Agent, or Firm* — Norton Rose Fulbright US LLP; James R. Crawford

(57) ABSTRACT

Scroll compressor includes a shaft rotatably supported to a casing; an eccentric bush having a recess part into which one end portion of the shaft is inserted, an eccentric part eccentric to the shaft, and a balance weight disposed at the opposite side of the eccentric part with respect to the recess part; an orbiting scroll for performing the orbiting motion in interlock with the eccentric part; and a fixed scroll for forming a compression chamber together with the orbiting scroll. The casing has an orbiting groove in which the eccentric bush performs the orbiting motion, a buffer member is interposed between the orbiting groove and the balance weight. Rotation clearance is formed between the recess part and the shaft. The buffer member is compressed between the balance weight and the orbiting groove before the recess part and the shaft contact each other by the rotation clearance.

8 Claims, 15 Drawing Sheets

--Prior Art--

--Prior Art--

--Prior Art--

--Prior Art--

--Prior Art--

SCROLL COMPRESSOR WITH BUFFER MEMBER BETWEEN THE ORBITING GROOVE AND THE BALANCE WEIGHT

This application claims priority from Korean Patent Application No. 10-2018-0083435 filed on Jul. 18, 2018. The entire contents of these applications are incorporated herein by reference in their entirety.

TECHNICAL FIELD

The present disclosure relates to a scroll compressor, and more particularly, to a scroll compressor, which can compress refrigerant with a fixed scroll and an orbiting scroll.

BACKGROUND ART

Generally, a vehicle is provided with an Air Conditioning (NC) for cooling and heating the indoor. Such an air conditioner is a configuration of a cooling and heating system, and includes a compressor for compressing low-temperature and lower-pressure gas refrigerant flowed from an evaporator into high-temperature and high-pressure gas refrigerant to send it to a condenser.

The compressor includes a reciprocating type for compressing the refrigerant according to the reciprocating motion of a piston, and a rotary type for compressing while performing the rotating motion. The reciprocating type includes a crank type for transferring it to a plurality of pistons by using a crank according to a transfer method of a driving source, a swash plate type for transferring it to a shaft installed with a swash plate, etc., and the rotary type includes a vane rotary type using a rotating rotary shaft and a vane, and a scroll type using an orbiting scroll and a fixed scroll.

The scroll compressor is widely used for compressing refrigerant in the air conditioner, etc. because it can obtain a relatively high compression ratio as compared with other types of compressors and smoothly advance suction, compression, and discharge strokes of the refrigerant to obtain a stable torque.

FIG. 1 is a cross-sectional diagram showing a conventional scroll compressor, FIG. 2 is an exploded perspective diagram showing a shaft and an eccentric bush in the scroll compressor of FIG. 1, FIG. 3 is a cross-sectional diagram showing the positional relationship between the shaft and the eccentric bush when the scroll compressor of FIG. 1 normally operates, FIG. 4 is a cross-sectional diagram showing a state where the eccentric bush of FIG. 3 has been rotated with respect to the shaft by the rotation clearance, and FIG. 5 is a cross-sectional diagram showing a state where the eccentric bush of FIG. 4 has been further rotated with respect to the shaft by the rotation clearance.

Referring to FIGS. 1 and 2, a conventional scroll compressor includes a driving source 200 for generating a rotating force, a shaft 300 rotated by the driving source 200, an eccentric bush 400 having a recess part 410 into which one end portion of the shaft 300 is inserted and an eccentric part 420 eccentric to the shaft 300, an orbiting scroll 500 communicated with the eccentric part 420 to perform the orbiting motion, and a fixed scroll 600 forming a compression chamber together with the orbiting scroll 500.

Herein, the eccentric bush 400 is, for example, formed so that the rotation clearance is present between the inner circumferential surface 412 of the recess part 410 and the outer circumferential surface 312 of the one end portion 310 of the shaft 300, in order to prevent damage to the orbiting scroll 500 and the fixed scroll 600 due to the liquid refrigerant compression as in the initial operation. That is, the eccentric bush 400 is formed so that the rotating motion of the shaft 300 is not transferred to the eccentric bush 400 and transferred in a buffered manner according to the designed rotation clearance, and therefore, at the normal operation, as shown in FIG. 3, the scroll compressor rotates together with the shaft 300 in a state where the recess part 410 and the shaft 300 are concentric with each other, but for example, at the initial operation, as shown in FIG. 4, the scroll compressor performs the rotating motion relative to the shaft 300 to be rotated together with the shaft 300 in a state where the orbiting radius of the eccentric part 420 has been adjusted.

However, there has been a problem in that in such a conventional scroll compressor, for example, when the rotating speed of the shaft 300 is reduced or the rotation of the shaft 300 is stopped, as shown in FIG. 5, the eccentric bush 400 strikes the shaft 300 by the rotation clearance to generate an shock sound, thereby deteriorating the noise vibration of the compressor.

DISCLOSURE

Technical Problem

The present disclosure is intended to solve the above problem, and an object of the present disclosure is to provide to a fuel processing apparatus, which is advantageous to enhance the heat transfer and the cooling efficiency through the optimal placement, stably perform the reforming reaction and the CO removing reaction, and miniaturize the apparatus.

Technical Solution

Therefore, an object of the present disclosure is to provide a scroll compressor, which can make the rotation clearance between a shaft and an eccentric bush so as to prevent the breakage of a scroll due to the liquid refrigerant compression at the initial operation, thereby preventing the impact noise between the shaft and the eccentric bush due to the rotation clearance.

For achieving the object, the present disclosure provides a scroll compressor including a casing; a shaft rotatably supported to the casing; an eccentric bush having a recess part into which one end portion of the shaft is inserted, an eccentric part eccentric to the shaft, and a balance weight disposed at the opposite side of the eccentric part with respect to the recess part; an orbiting scroll for performing the orbiting motion in interlock with the eccentric part; and a fixed scroll for forming a compression chamber together with the orbiting scroll, and the casing is formed with an orbiting groove in which the eccentric bush can perform the orbiting motion, a buffer member is interposed between the orbiting groove and the balance weight, the rotation clearance is formed to be present between the inner circumferential surface of the recess part and the outer circumferential surface of the one end portion of the shaft, and the buffer member is formed to be compressed between the outer circumferential surface of the balance weight and the inner circumferential surface of the orbiting groove before the inner circumferential surface of the recess part and the outer circumferential surface of the one end portion of the shaft contact each other by the rotation clearance.

When the recess part is disposed at a position concentric with the one end portion of the shaft, a gap between the inner circumferential surface of the recess part and the outer circumferential surface of the one end portion of the shaft can be constantly formed, and a gap between the outer circumferential surface of the balance weight and the inner circumferential surface of the orbiting groove can be constantly formed, on any plane perpendicular to the one end portion of the shaft.

The buffer member can be mounted on the inner circumferential surface of the orbiting groove and formed to be contactable with the outer circumferential surface of the balance weight.

The buffer member can be formed in an annular shape extending along the inner circumferential surface of the orbiting groove.

When the recess part is disposed at a position concentric with the one end portion of the shaft, a gap between the outer circumferential surface of the balance weight and the inner circumferential surface of the buffer member can be constantly formed.

When the recess part is disposed at a position concentric with the one end portion of the shaft, the gap between the outer circumferential surface of the balance weight and the inner circumferential surface of the buffer member can be formed narrower than the gap between the inner circumferential surface of the recess part and the outer circumferential surface of the one end portion of the shaft.

The buffer member can be mounted on the outer circumferential surface of the balance weight and formed to be contactable with the inner circumferential surface of the orbiting groove.

When one end portion in the circumferential direction on the outer circumferential surface of the balance weight is referred to as a first end portion, and the other end portion in the circumferential direction on the outer circumferential surface of the balance weight is referred to as a second end portion, the buffer member can be formed in a protrusion shape protruded to the outside of the radius direction from at least one of the first end portion or the second end portion.

When the recess part is disposed at a position concentric with the one end portion of the shaft, a gap between a distal end surface of the buffer member and the inner circumferential surface of the orbiting groove can be formed narrower than the gap between the inner circumferential surface of the recess part and the outer circumferential surface of the one end portion of the shaft.

The outer circumferential surface of the balance weight can be formed with a buffer member fastening groove engraved from the outer circumferential surface of the balance weight, and the buffer member can have one end portion of the buffer weight inserted into and fastened to the buffer member fastening groove and the other end portion of the buffer member formed to be protruded to the outside of the buffer member fastening groove.

At least one of the inner circumferential surface of the buffer member fastening groove and the outer circumferential surface of the one end portion of the buffer member can be formed with an unevenness for preventing the buffer member from being detached from the buffer member fastening groove.

The inner circumferential surface of the buffer member fastening groove can be formed with a female screw, and the outer circumferential surface of the one end portion of the buffer member can be formed with a male screw engaged with the female screw.

When the recess part is disposed at a position concentric with the one end portion of the shaft, the gap between the outer circumferential surface of the balance weight and the inner circumferential surface of the orbiting groove can be formed to be equal to or wider than the gap between the inner circumferential surface of the recess part and the outer circumferential surface of the one end portion of the shaft.

The buffer member can be made of a material having an elastic modulus smaller than those of the balance weight and the orbiting groove.

The axial direction of the orbiting groove can be formed to be inclined with the gravitational direction, and oil can be stored in the lower portion in the gravitational direction of the orbiting groove.

BEST MODE

Hereinafter, a scroll compressor according to the present disclosure will be described in detail with reference to the accompanying drawings.

Figure 1:
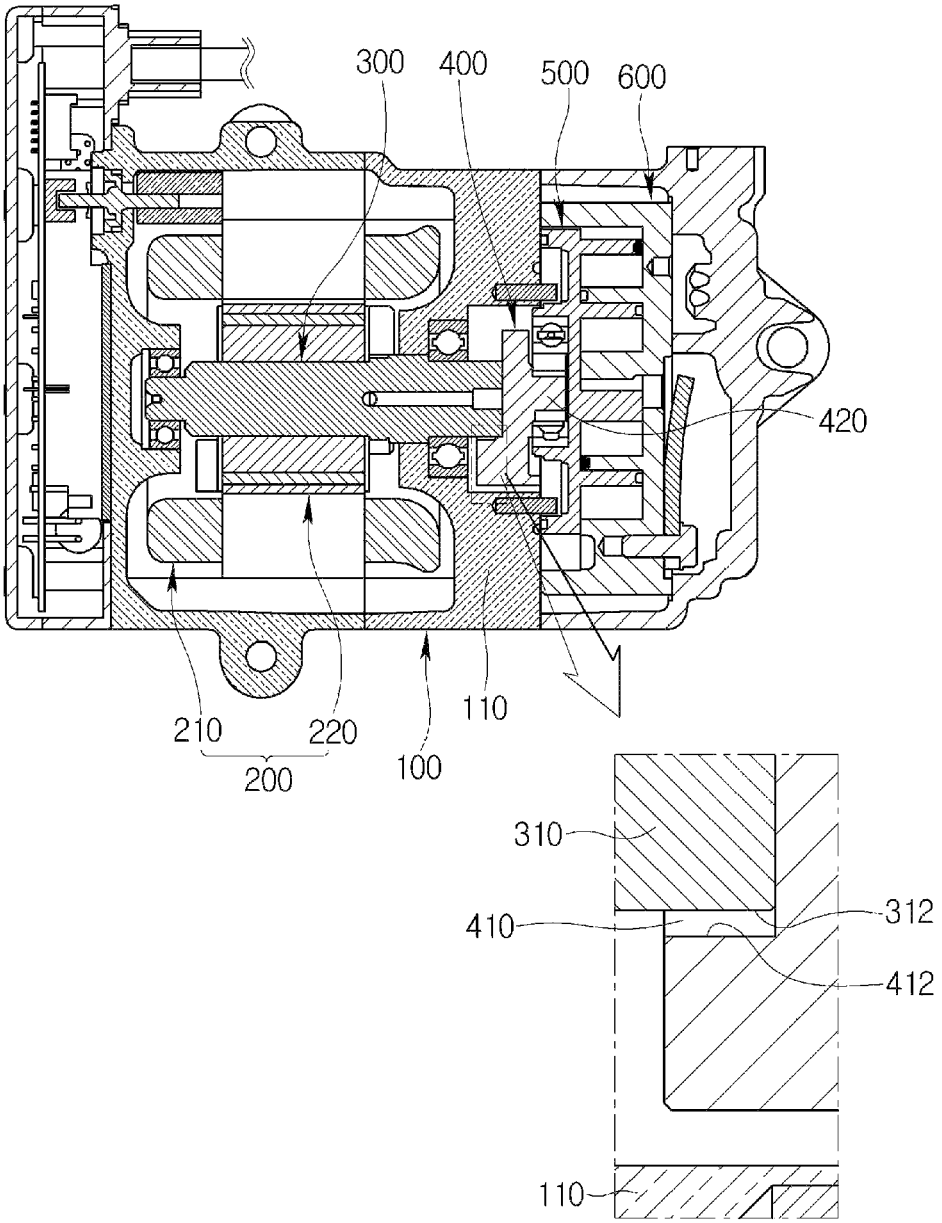
FIG. 1 is a cross-sectional diagram showing a conventional scroll compressor.
Figure 2:
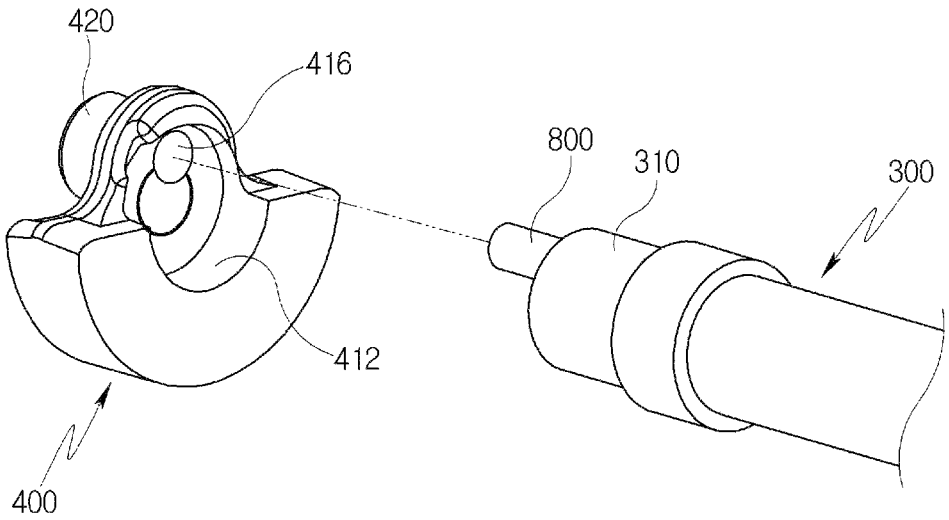
FIG. 2 is an exploded perspective diagram showing a shaft and an eccentric bush in the scroll compressor of FIG. 1.
Figure 3:
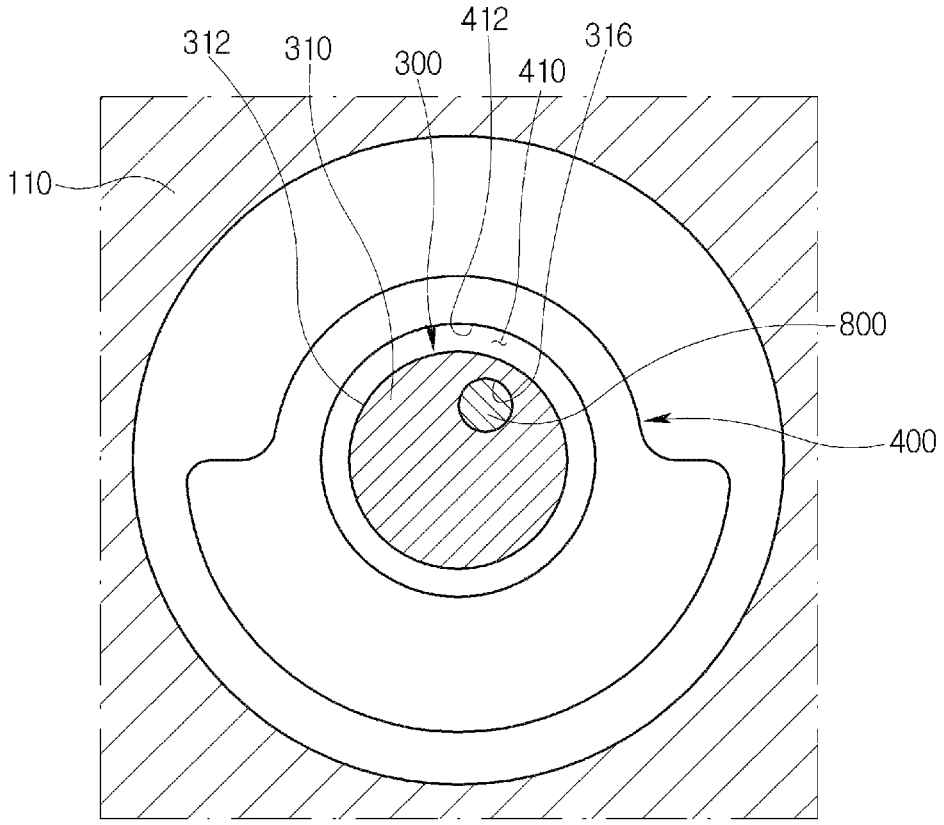
FIG. 3 is a cross-sectional diagram showing the positional relationship between the shaft and the eccentric bush at the normal operation of the scroll compressor of FIG. 1.
Figure 4:
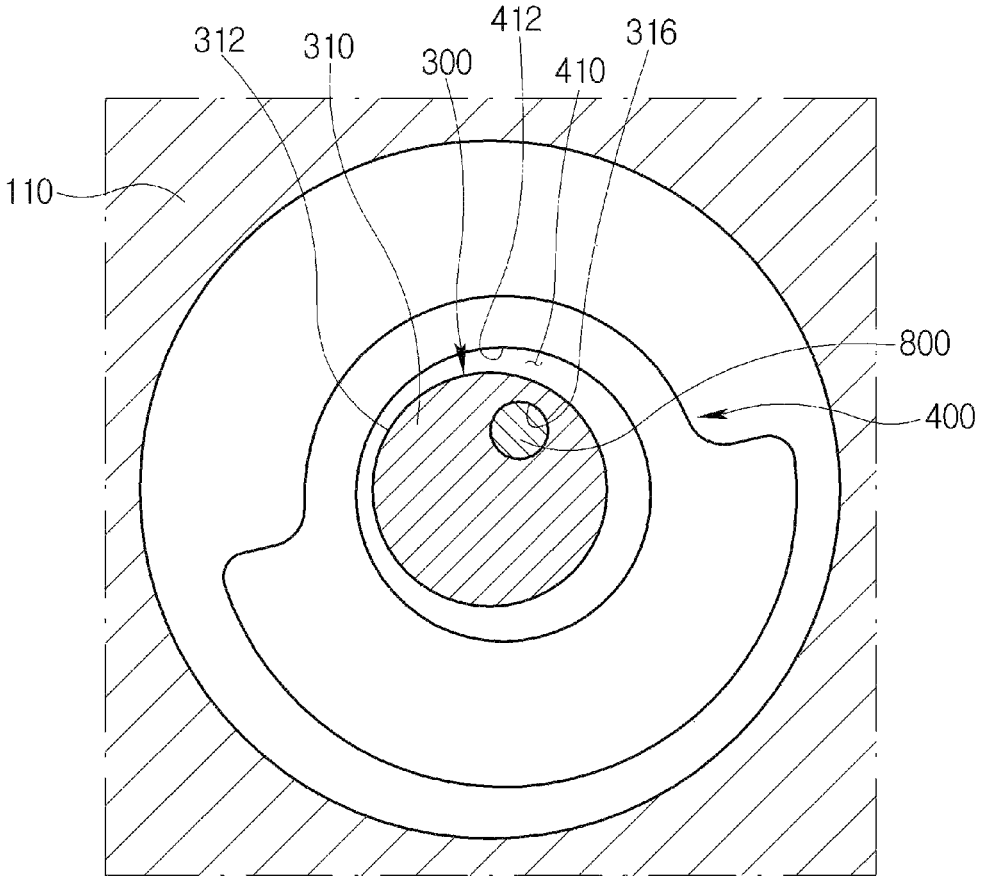
FIG. 4 is a cross-sectional diagram showing a state where the eccentric bush of FIG. 3 has been rotated by the rotation clearance with respect to the shaft.
Figure 5:
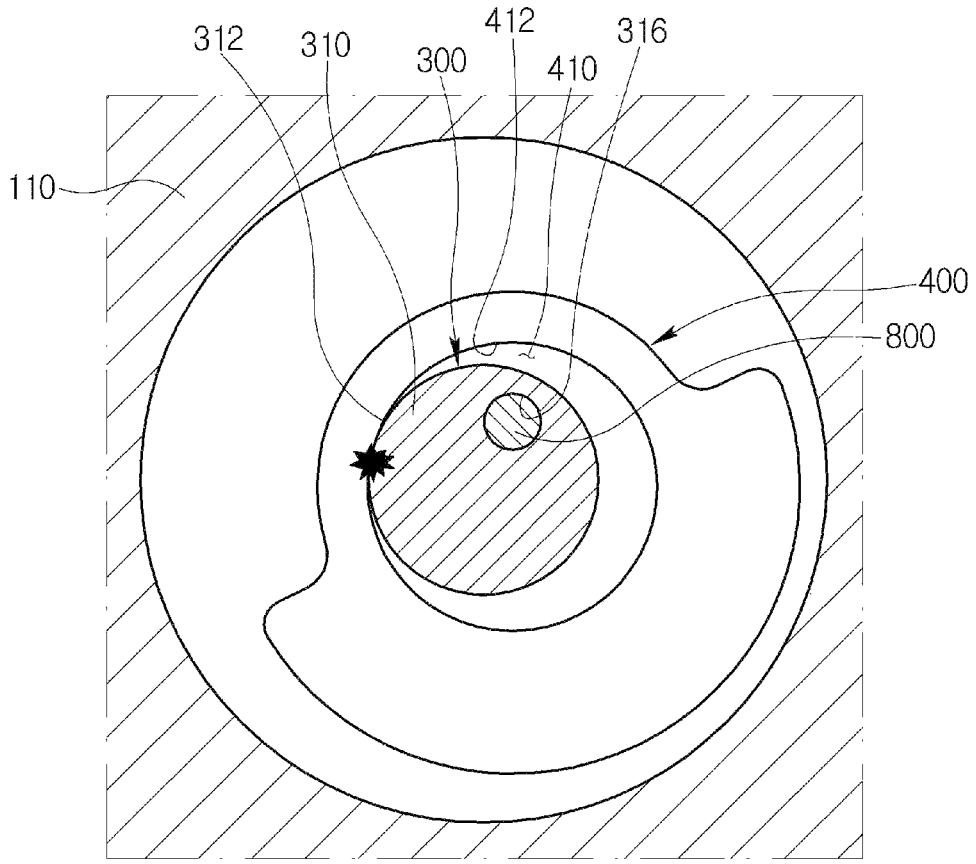
FIG. 5 is a cross-sectional diagram showing a state where the eccentric bush of FIG. 4 has been further rotated by the rotation clearance with respect to the shaft.
Figure 6:
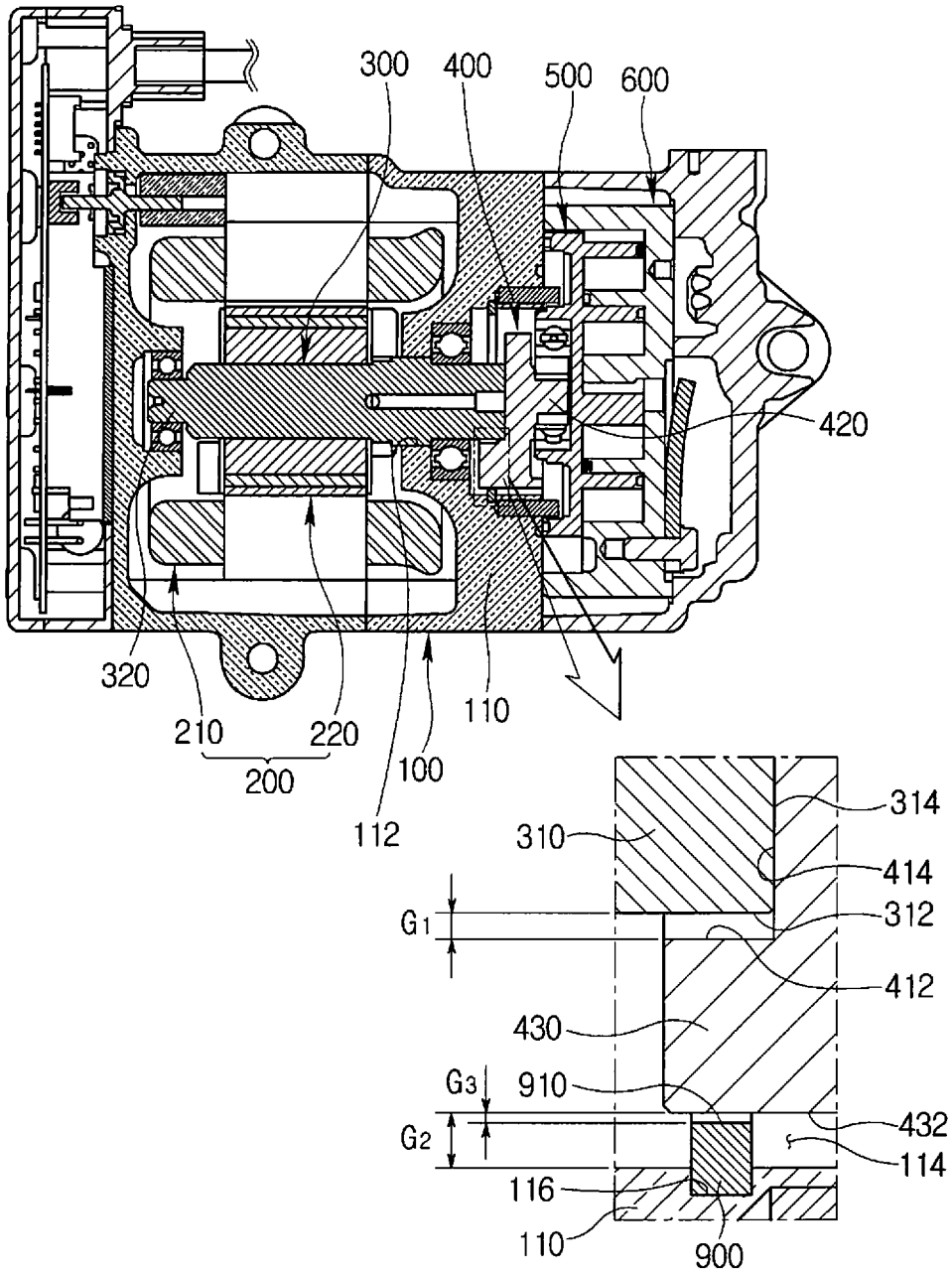
FIG. 6 is a cross-sectional diagram showing a scroll compressor according to an embodiment of the present disclosure.
Figure 7:
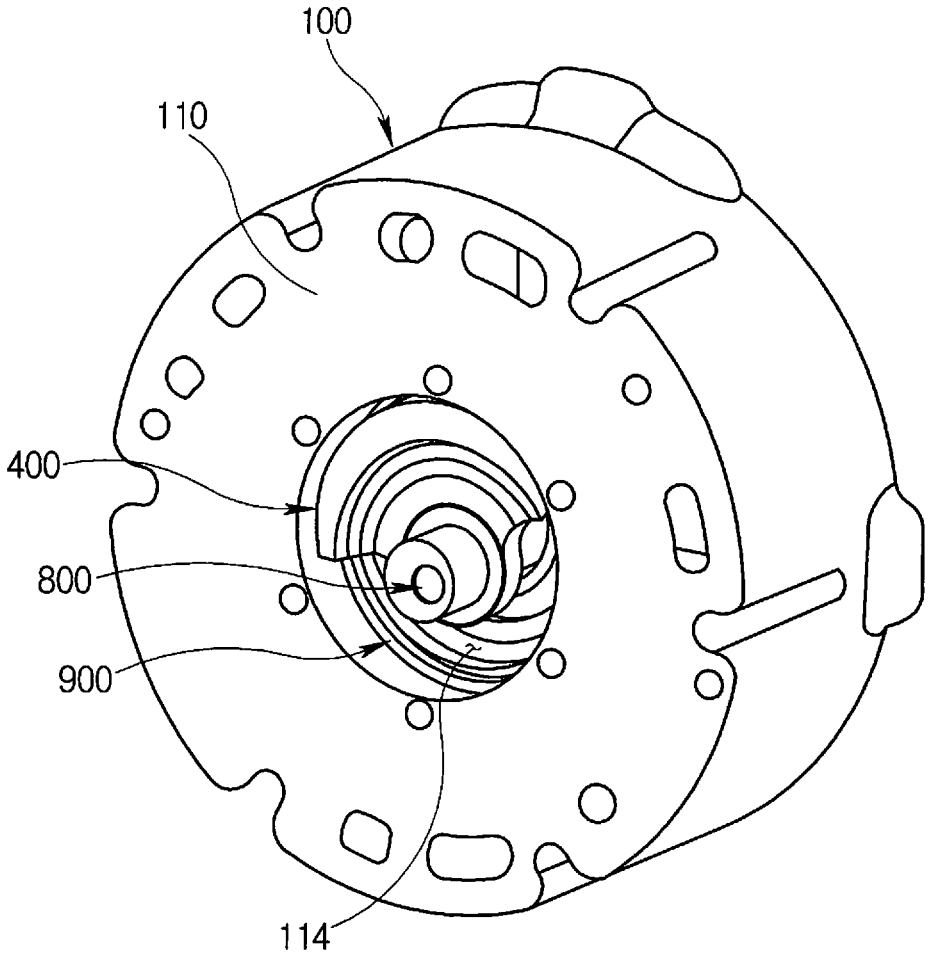
FIG. 7 is a perspective diagram showing a shaft, an eccentric bush, a casing, and a buffer member in the scroll compressor of FIG. 6.
Figure 8:
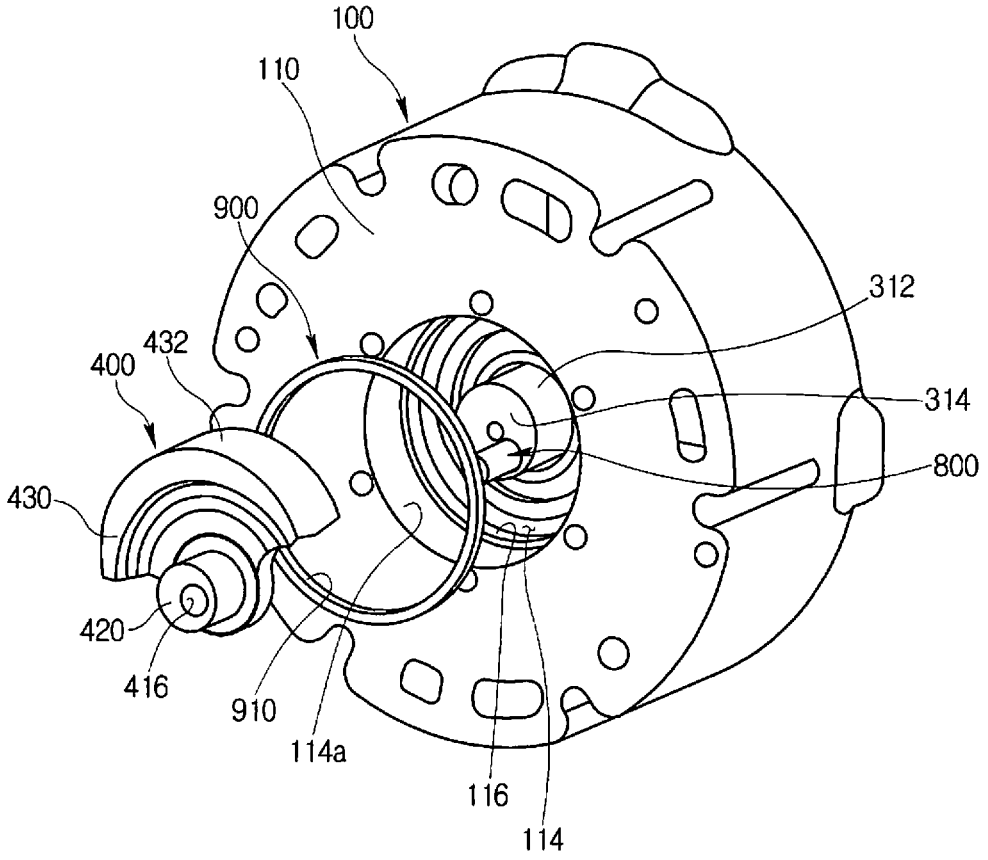
FIG. 8 is an exploded perspective diagram of FIG. 7.
Figure 9:
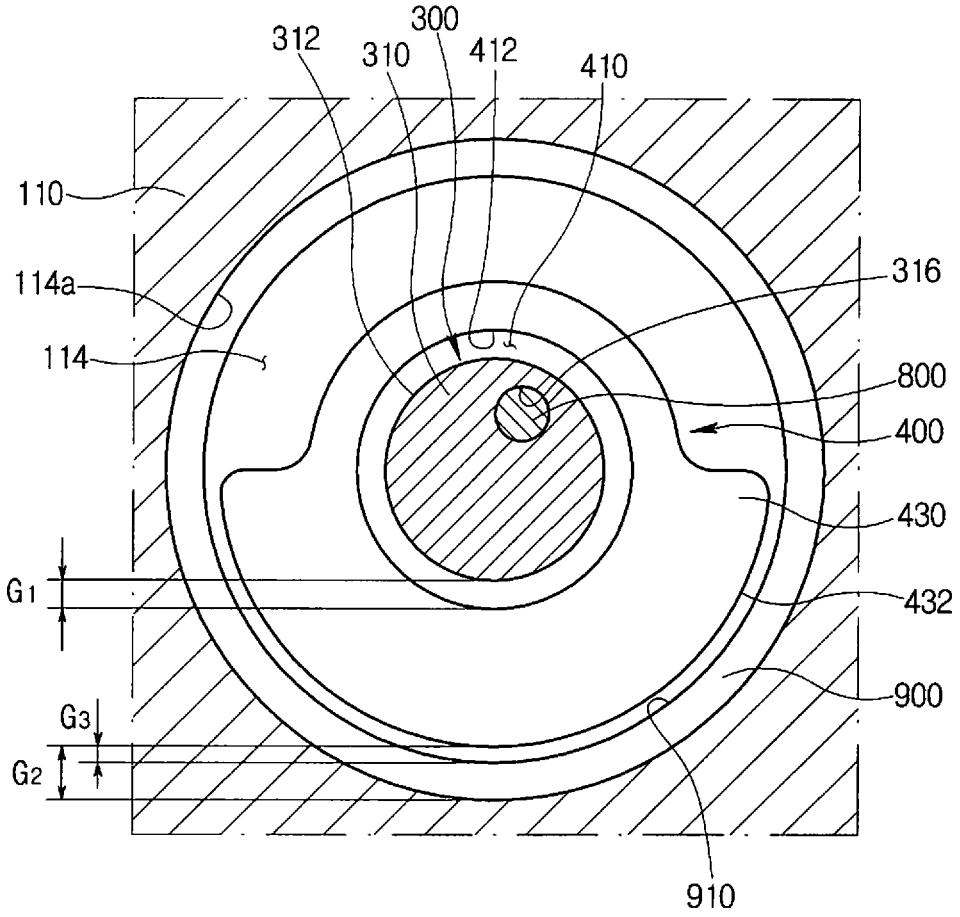
FIG. 9 is a cross-sectional diagram showing the positional relationship of the shaft, the eccentric bush, the casing, and the buffer member at the normal operation of the scroll compressor of FIG. 6.
Figure 10:
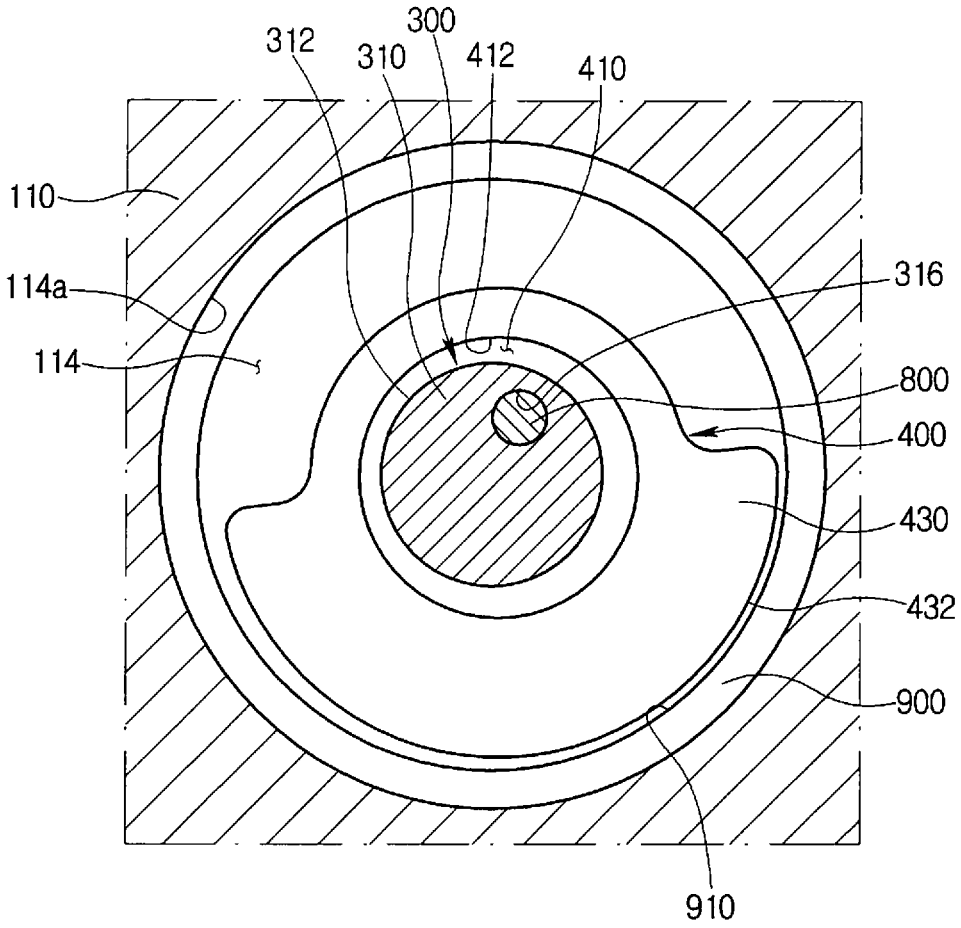
FIG. 10 is a cross-sectional diagram showing a state where the eccentric bush of FIG. 9 has been rotated by the rotation clearance with respect to the shaft.
Figure 11:
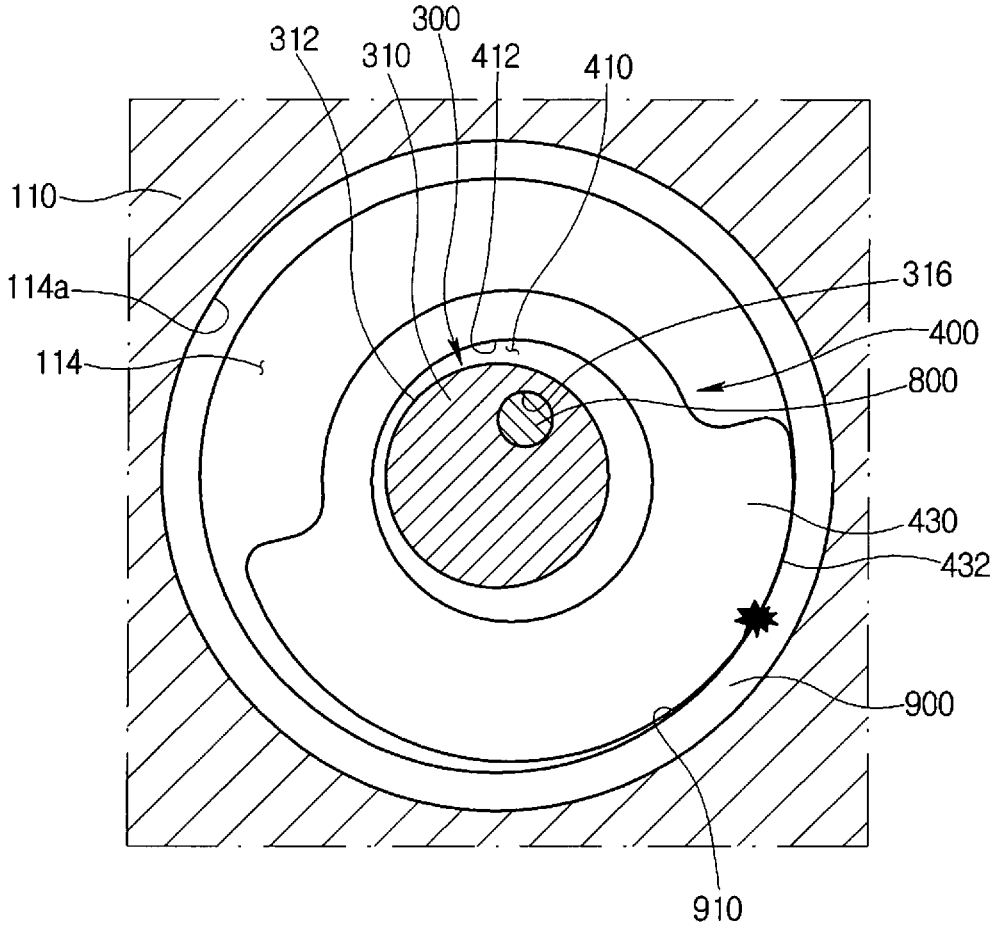
FIG. 11 is a cross-sectional diagram showing a state where the eccentric bush of FIG. 10 has been further rotated by the rotation clearance with respect to the shaft.
Figure 12:
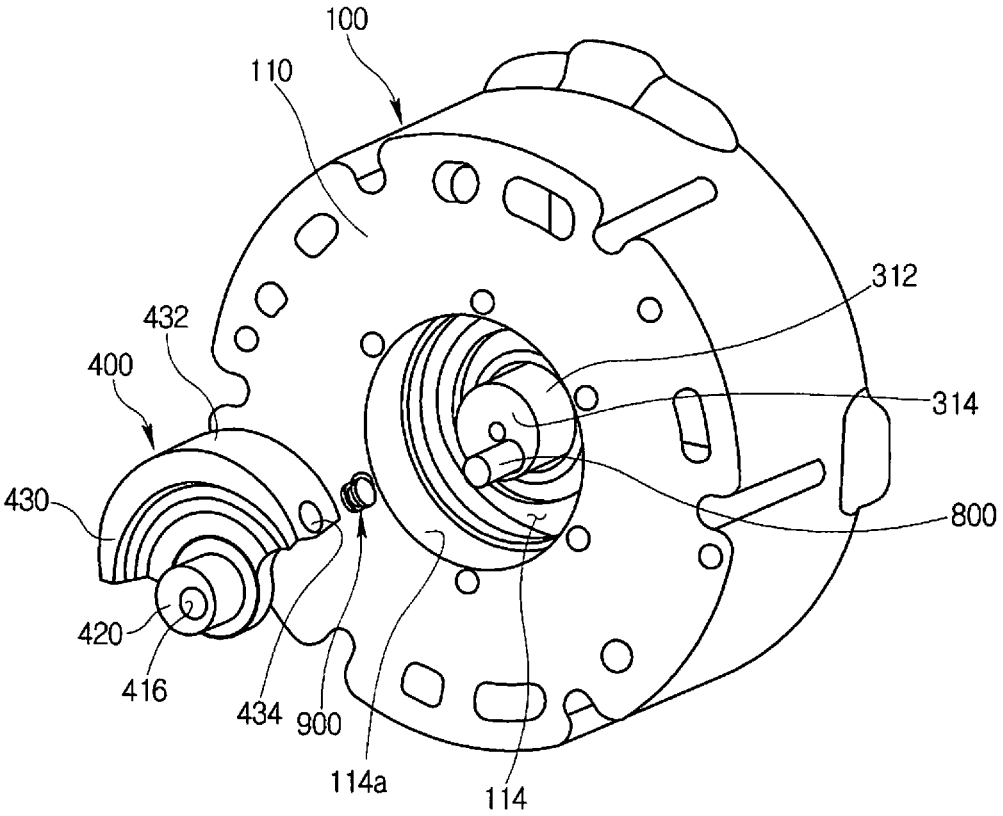
FIG. 12 is an exploded perspective diagram showing a shaft, an eccentric bush, a casing, and a buffer member in a scroll compressor according to another embodiment of the present disclosure.

FIG. 6 is a cross-sectional diagram showing a scroll compressor according to an embodiment of the present disclosure, FIG. 7 is a perspective diagram showing a shaft, an eccentric bush, a casing, and a buffer member in the scroll compressor of FIG. 6, FIG. 8 is an exploded perspective diagram of FIG. 7, FIG. 9 is a cross-sectional diagram showing the positional relationship of the shaft, the eccentric bush, the casing, and the buffer member at the normal operation of the scroll compressor of FIG. 6, FIG. 10 is a cross-sectional diagram showing a state where the eccentric bush of FIG. 9 has been rotated by the rotation clearance with respect to the shaft, and FIG. 11 is a cross-sectional diagram showing a state where the eccentric bush of FIG. 10 has been further rotated by the rotation clearance with respect to the shaft.

Referring to FIGS. 6 to 11, a scroll compressor according to an embodiment of the present disclosure can include a casing 100, a driving source 200 provided inside the casing 100 to generate a rotating force, a shaft 300 rotated by the driving source 200, an eccentric bush 400 for converting the rotary motion of the shaft 300 into the eccentric rotary motion, an orbiting scroll 500 for performing the orbiting motion in interlock with the eccentric bush 400, and a fixed scroll 600 forming a compression chamber together with the orbiting scroll 500.

The casing 100 can include a main frame 110 for supporting the orbiting scroll 500.

The main frame 110 can be formed with a shaft accommodating hole 112 through which the shaft 300 passes.

The shaft accommodating hole 112 can be formed with a bearing for rotatably supporting the shaft 300.

Then, the main frame 110 can be formed with an orbiting groove 114 in which the eccentric bush 400 can perform the orbiting motion.

The orbiting groove 114 can be formed to be engraved on one surface of the main frame 110 facing the orbiting scroll 500, and formed to be communicated with the shaft accommodating hole 112.

Then, the inner circumferential surface 114*a* of the orbiting groove 114 can be formed with a buffer member support groove 116 into which a buffer member 900 described later is inserted.

The driving source 200 can be formed as a motor having a stator 210 and a rotor 220. Herein, the driving source 200 can also be formed as a disk hub assembly interlocked with an engine of a vehicle.

The shaft 300 can be formed in a cylindrical shape extending in one direction, coupled with the eccentric bush 400 on one end portion 310 of the shaft 300, and coupled with the rotator 220 on the other end portion 320 of the shaft 300.

The eccentric bush 400 can include a recess part 410 into which the one end portion 310 of the shaft 300 is inserted, an eccentric part 420 protruded to the opposite side of the one end portion 310 of the shaft 300 with respect to the recess part 410 and eccentric to the shaft 300, and a balance weight 430 disposed on the opposite side of the eccentric part 420 with respect to the recess part 410 in order to balance the overall rotation of the eccentric bush 400.

Herein, the shaft 300 and the eccentric bush 400 can be, for example, formed so that the rotation clearance is present between an inner circumferential surface 412 of the recess part 410 and an outer circumferential surface 312 of the one end portion 310 of the shaft 300, in order to prevent the breakage of the scroll due to the liquid refrigerant compression as in the initial operation.

That is, the shaft 300 and the eccentric bush 400 can be coupled to perform the rotary motion relative to each other with respect to the position eccentric from the rotary axis of the shaft 300.

Specifically, the one end portion 310 of the shaft 300 can be formed in a cylindrical shape. That is, the outer circumferential surface 312 of the one end portion 310 of the shaft 300 can be formed to have a constant outer diameter regardless of the axial position of the shaft 300.

Then, a distal end surface 314 of the one end portion 310 of the shaft 300 can be formed with a hinge pin one end portion insertion groove 316 into which the one end portion of a hinge pin 800 for fastening the shaft 300 and the eccentric bush 400 is inserted.

The hinge pin one end portion insertion groove 316 can be formed at a position where the center of the hinge pin one end portion insertion groove 316 has been spaced in the radius direction from the rotary axis of the shaft 300 so that the central axis of the hinge pin 800 is disposed at a position eccentric to the rotary axis of the shaft 300.

Then, the hinge pin 800 can be formed in a cylindrical shape extending in the direction parallel to the axial direction of the shaft 300, and the hinge pin one end portion insertion groove 316 can be formed to be engraved in a cylindrical shape having the inner diameter of the same level as the outer diameter of the hinge pin 800 so as to correspond to the hinge pin 800.

The recess part 410 of the eccentric bush 400 can be formed to be engraved in a cylindrical shape so as to correspond to the one end portion 310 of the shaft 300. That is, the inner circumferential surface 412 of the recess part 410 can be formed to have a constant inner diameter regardless of the axial position of the recess part 410.

Then, the recess part 410 can be formed so that the inner diameter of the recess part 410 is greater than the outer diameter of the one end portion 310 of the shaft 300 in order for the eccentric bush 400 to be rotatable relative to the shaft 300 with respect to the hinge pin 800. That is, a gap G1 between the inner circumferential surface 412 of the recess part 410 and the outer circumferential surface 312 of the one end portion 310 of the shaft 300 can be formed wider than zero. Herein, the gap G1 between the inner circumferential surface 412 of the recess part 410 and the outer circumferential surface 312 of the one end portion 310 of the shaft 300 is formed to have a predetermined value or more so that the inner circumferential surface 412 of the recess part 410 and the outer circumferential surface 312 of the one end portion 310 of the shaft 300 do not contact each other and a description thereof will be described later.

Then, a base surface 414 of the recess part 410 facing the distal end surface 314 of the one end portion 310 of the shaft 300 can be formed with a hinge pin the other portion insertion groove 416 into which the other end portion of the hinge pin 800 is inserted.

The hinge pin the other end insertion groove 416 can be formed at a position where the center of the hinge pin the other portion insertion groove 416 has been spaced in the radius direction of the recess part 410 from the central axis of the recess part 410 so that the central axis of the hinge pin 800 is disposed at a position eccentric to the central axis of the recess part 410. Herein, the hinge pin the other end portion insertion groove 416 can be preferably formed at a position facing the hinge pin one end portion insertion groove 316 when the recess part 410 is disposed at a position concentric with the one end portion 310 of the shaft 300 so that the eccentric bush 400 can perform the relative rotary motion in one direction and the opposite direction with respect to the shaft 300.

Then, the hinge pin the other end portion insertion groove 416 can be formed to be engraved in a cylindrical shape having the inner diameter of the same level as the outer diameter of the hinge pin 800 so as to correspond to the hinge pin 800.

Meanwhile, in the scroll compressor according to the present embodiment, for example, when the rotation of the shaft 300 is stopped, in order to prevent shock sound from being generated by the eccentric bush 400 hitting the shaft 300 by the rotation clearance, the buffer member 900 can be interposed between the orbiting groove 114 and the balance weight 430, and the buffer member 900 can be formed to be compressed between an outer circumferential surface 432 of the balance weight 430 and the inner circumferential surface 114*a* of the orbiting groove 114 before the inner circumferential surface 412 of the recess part 410 and the outer circumferential surface 312 of the one end portion 310 of the shaft 300 contact each other.

Specifically, the buffer member 900 is formed in an annular shape extending along the inner circumferential surface 114*a* of the orbiting groove 114, formed to be contactable with the outer circumferential surface 432 of the balance weight 430 in a state fastened to the buffer member support groove 116, and for example, made of a material having an elastic modulus (hardness) smaller than those of the material constituting the balance weight 430 and the material constituting the orbiting groove 114 such as a PTFE, a plastic, or a rubber.

Then, the buffer member 900 can be formed so that the inner diameter of the buffer member 900 is included in a predetermined range.

More specifically, based on when the recess part 410 is disposed at a position concentric with the one end portion 310 of the shaft 300, on any plane perpendicular to the one end portion 310 of the shaft 300, the gap G1 between the inner circumferential surface 412 of the recess part 410 and the outer circumferential surface 312 of the one end portion 310 of the shaft 300 is constantly formed, the gap G2 between the outer circumferential surface 432 of the balance weight 430 and the inner circumferential surface 114*a* of the orbiting groove 114 is constantly formed, and the gap G3 between the outer circumferential surface 432 of the balance weight 430 and the inner circumferential surface 910 of the buffer member 900 is constantly formed, and at this time, the gap G3 between the outer circumferential surface 432 of the balance weight 430 and the inner circumferential surface 910 of the buffer member 900 can be formed narrower than the gap G1 between the inner circumferential surface 412 of the recess part 410 and the outer circumferential surface 312 of the one end portion 310 of the shaft 300.

Herein, based on when the recess part 410 is disposed at a position concentric with the one end portion 310 of the shaft 300, the gap G1 between the inner circumferential surface 412 of the recess part 410 and the outer circumferential surface 312 of the one end portion 310 of the shaft 300, the gap G2 between the outer circumferential surface 432 of the balance weight 430 and the inner circumferential surface 114*a* of the orbiting groove 114, and the gap G3 between the outer circumferential surface 432 of the balance weight 430 and the inner circumferential surface 910 of the buffer member 900 can be all formed wider than zero.

Meanwhile, based on when the recess part 410 is disposed at a position concentric with the one end portion 310 of the shaft 300, on any plane perpendicular to the one end portion 310 of the shaft 300, the gap G2 between the outer circumferential surface 432 of the balance weight 430 and the inner circumferential surface 114*a* of the orbiting groove 114 is formed to be equal to or wider than the gap G1 between the inner circumferential surface 412 of the recess part 410 and the outer circumferential surface 312 of the one end portion 310 of the shaft 300, and the operation effect thereof will be described later.

Hereinafter, the operation effect of the scroll compressor according to the present embodiment will be described.

That is, when power is applied to the driving source 200, a series of procedures can be repeated in which the shaft 300 is rotated together with the rotor 220, the orbiting scroll 500 performs the orbiting motion in interlock with the shaft 300 through the eccentric bush 400, and the refrigerant is sucked into the compression chamber by the orbiting motion of the orbiting scroll 500, compressed in the compression chamber, and discharged from the compression chamber.

Herein, in the scroll compressor according to the present embodiment, as the rotation clearance is formed between the shaft 300 and the eccentric bush 400 (more accurately, between the outer circumferential surface 312 of the one end portion 310 of the shaft 300 and the inner circumferential surface 412 of the recess part 410), the eccentric bush 400 is rotated together with the shaft 300 in a state where the recess part 410 and the shaft 300 are concentric with each other at the normal operation of the scroll compressor, as shown in FIG. 9, but for example, when the liquid refrigerant is present as in the initial operation, as shown in FIG. 10, the eccentric bush 400 can perform the rotary motion relative to the shaft 300 to be rotated together with the shaft 300 in a state where the orbiting radius of the eccentric part 420 has been adjusted. That is, the rotary motion of the shaft 300 can be transferred in a buffered manner according to the designed rotation clearance without being transferred to the eccentric bush 400 immediately. Therefore, the breakage of the scroll due to the liquid refrigerant compression can be prevented.

In addition, the buffer member 900 can be provided between the outer circumferential surface 432 of the balance weight 430 and the inner circumferential surface 114*a* of the orbiting groove 114, and as the gap G3 between the outer circumferential surface 432 of the balance weight 430 and the inner circumferential surface 910 of the buffer member 900 is formed narrower than the gap G1 between the inner circumferential surface 412 of the recess part 410 and the outer circumferential surface 312 of the one end portion 310 of the shaft 300 based on when the recess part 410 is disposed at a position concentric with the one end portion 310 of the shaft 300, the shock sound between the shaft 300 and the eccentric bush 400 can be prevented. That is, when the eccentric bush 400 is further rotated than the state of FIG. 10 with respect to the shaft 300, as shown in FIG. 11, the outer circumferential surface 432 of the balance weight 430 first contacts the inner circumferential surface 910 of the buffer member 900 before the inner circumferential surface 412 of the recess part 410 and the outer circumferential surface 312 of the one end portion 310 of the shaft 300 contact each other, and the buffer member 900 is compressed between the outer circumferential surface 432 of the balance weight 430 and the inner circumferential surface 114*a* of the orbiting groove 114, such that the inner circumferential surface 412 of the recess part 410 can be prevented from hitting the outer circumferential surface 312 of the one end portion 310 of the shaft 300.

In addition, the gap G2 between the outer circumferential surface 432 of the balance weight 430 and the inner circumferential surface 114*a* of the orbiting groove 114 is formed to be equal to or wider than the gap G1 between the inner circumferential surface 412 of the recess part 410 and the outer circumferential surface 312 of the one end portion 310 of the shaft 300 based on when the recess part 410 is disposed at a position concentric with the one end portion 310 of the shaft 300, such that the eccentric bush 400 can be prevented from being locked to the orbiting groove 114. That is, unlike the present embodiment, when the gap G2 between the outer circumferential surface 432 of the balance weight 430 and the inner circumferential surface 114*a* of the orbiting groove 114 is formed narrower than the gap G1 between the inner circumferential surface 412 of the recess part 410 and the outer circumferential surface 312 of the one end portion 310 of the shaft 300 based on when the recess part 410 is disposed at a position concentric with the one end portion 310 of the shaft 300 (e.g., when the inner circumferential surface 114*a* of the orbiting groove 114 is formed at a position of the inner circumferential surface 910 of the buffer member 900 of FIG. 11), the rotation trajectory of the balance weight 430 and the orbiting groove 114 are interfered with each other, and the balance weight 430 and the orbiting groove 114 made of a material having a large elastic modulus (hardness) are difficult to be deformed, such that when the eccentric bush 400 is further rotated than the state of FIG. 10 with respect to the shaft 300, the balance weight 430 can be locked to the orbiting groove 114. However, in the present embodiment, based on when the recess part 410 is disposed at a position concentric with the one end portion 310 of the shaft 300, the gap G3 between the outer circumferential surface 432 of the balance weight 430 and the inner circumferential surface 910 of the buffer member 900 is formed narrower than the gap G1 between the inner circumferential surface 412 of the recess part 410 and the outer circumferential surface 312 of the one end portion 310 of the shaft 300, such that the rotation trajectory of the balance weight 430 and the buffer member 900 are interfered with each other, but the gap G2 between the outer circumferential surface 432 of the balance weight 430 and the inner circumferential surface 114*a* of the orbiting groove 114 is formed to be equal to or wider than the gap G1 between the inner circumferential surface 412 of the recess part 410 and the outer circumferential surface 312 of the one end portion 310 of the shaft 300, such that the rotation trajectory of the balance weight 430 and the orbiting groove 114 are not interfered with each other, and as the buffer member 900 is made of a material having an elastic modulus (hardness) lower than those of the material constituting the balance weight 430 and the material constituting the orbiting groove 114, the buffer member 900 is compressed and restored between the balance weight 430 and the orbiting groove 114 when the eccentric bush 400 is further rotated than the state of FIG. 10 with respect to the shaft 300, such that the balance weight 430 can be prevented from being locked to the orbiting groove 114.

In addition, when the axial direction of the shaft 300 is formed to be inclined (preferably, almost perpendicular) to the gravitational direction, the axial direction of the orbiting groove 114 is formed to be inclined (preferably, perpendicular) to the gravitational direction, and as the oil for lubrication of the compressor is stored in the lower portion of the orbiting groove 114 in the gravitational direction, the shock sound can be prevented more effectively, and the locking can be prevented more effectively. That is, when the eccentric bush 400 is rotated, the oil stored in the orbiting groove 114 is stained on the outer circumferential surface 432 of the balance weight 430, the oil stained on the outer circumferential surface 432 of the balance weight 430 forms an oil film between the outer circumferential surface 432 of the balance weight 430 and the inner circumferential surface 910 of the buffer member 900, and the oil film can support the balance weight 430 together with the buffer member 900 when the eccentric bush 400 is further rotated than the state of FIG. 10 with respect to the shaft 300, thereby preventing the collision between the shaft 300 and the eccentric bush 400. In addition, the oil film can absorb the shock between the outer circumferential surface 432 of the balance weight 430 and the inner circumferential surface 910 of the buffer member 900, thereby preventing the collision noise between the balance weight 430 and the buffer member 900 more effectively. Then, the oil film can lubricate between the outer circumferential surface 432 of the balance weight 430 and the inner circumferential surface 910 of the buffer member 900, thereby preventing the locking of the balance weight 430 more effectively.

Meanwhile, in the present embodiment, the buffer member 900 is formed in an annular shape extending along the inner circumferential surface 114*a* of the orbiting groove 114, but is not limited thereto.

That is, although not shown separately, the buffer member 900 can be provided in plural, and the plurality of buffer members 900 can also be arranged at regular intervals along the inner circumferential surface 114*a* of the orbiting groove 114.

However, as the eccentric bush 400 is rotated in interlock with the shaft 300, the outer circumferential surface 432 of the balance weight 430 can be close to any portion of the inner circumferential surface 114*a* of the orbiting groove 114, and the outer circumferential surface 432 of the balance weight 430 can collide with the inner circumferential surface 114*a* of the orbiting groove 114 between the plurality of buffer members 900. In order to prevent this, as in the present embodiment, the buffer member 900 can be preferably formed in an annular shape.

In addition, in the present embodiment, the buffer member 900 can be mounted on the inner circumferential surface 114*a* of the orbiting groove 114 and formed to be contactable with the outer circumferential surface 432 of the balance weight 430, but as shown in FIGS. 12 to 15, the buffer member 900 can also be mounted on the outer circumferential surface 432 of the balance weight 430 and formed to be contactable with the inner circumferential surface 114*a* of the orbiting groove 114.

Specifically, when one end portion in the circumferential direction on the outer circumferential surface 432 of the balance weight 430 is referred to as a first end portion, and the other end portion in the circumferential direction on the outer circumferential surface 432 of the balance weight 430 is referred to as a second end portion, the buffer member 900 can be formed in a protrusion shape protruded from the first end portion or the second end portion outwards in the rotating radius direction of the eccentric bush 400.

Herein, the outer circumferential surface 432 of the balance weight 430 can be formed with a buffer member fastening groove 434 engraved from the outer circumferential surface 432 of the balance weight 430, and the buffer member 900 can have one end portion of the buffer member 900 inserted into and fastened to the buffer member fastening groove 434 and the other end portion of the buffer member 900 formed to be protruded to the outside of the fastening groove.

Then, in order to prevent the collision between the inner circumferential surface 412 of the recess part 410 and the outer circumferential surface 312 of the one end portion 310 of the shaft 300, based on when the recess part 410 is disposed at a position concentric with the one end portion 310 of the shaft 300, the gap G4 between the distal end surface 920 of the buffer member 900 and the inner circumferential surface 114*a* of the orbiting groove 114 can be formed wider than zero and narrower than the gap G1 between the inner circumferential surface 412 of the recess part 410 and the outer circumferential surface 312 of the one end portion 310 of the shaft 300.

Then, even in this case, in order to prevent the balance weight 430 from being locked to the orbiting groove 114, based on when the recess part is disposed at a position concentric with the one end portion 310 of the shaft 300, the gap G2 between the outer circumferential surface 432 of the balance weight 430 and the inner circumferential surface 114*a* of the orbiting groove 114 can be formed to be equal to or wider than the gap G1 between the inner circumferential surface 412 of the recess part 410 and the outer circumferential surface 312 of the one end portion 310 of the shaft 300.

Figure 13:
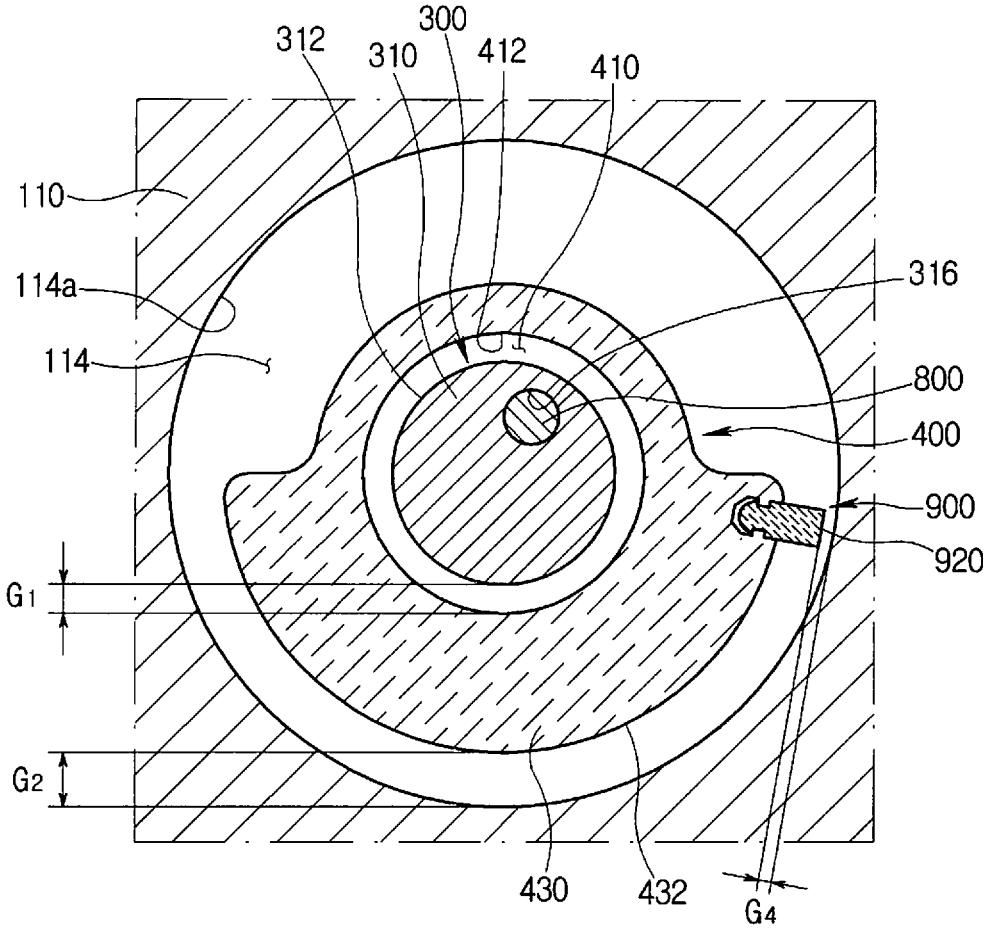
FIG. 13 is a cross-sectional diagram showing the positional relationship of the shaft, the eccentric bush, the casing, and the buffer member at the normal operation of the scroll compressor of FIG. 12.
Figure 14:
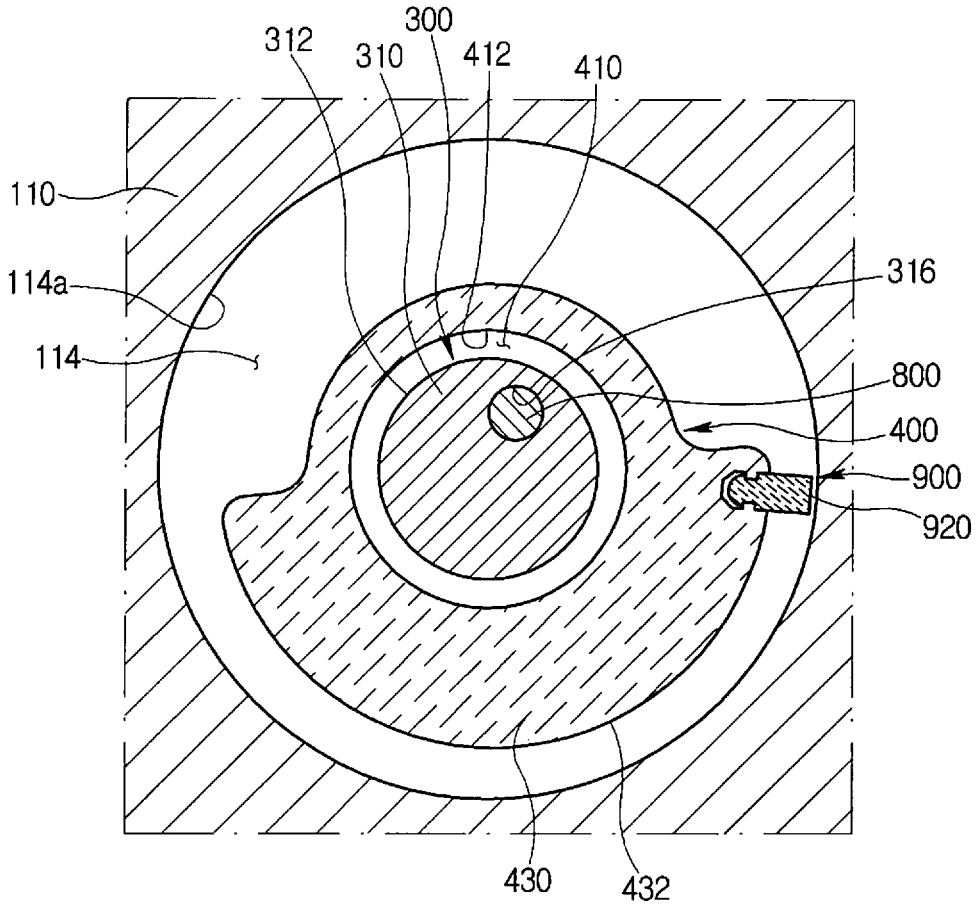
FIG. 14 is a cross-sectional diagram showing a state where the eccentric bush of FIG. 13 has been rotated by the rotation clearance with respect to the shaft.
Figure 15:
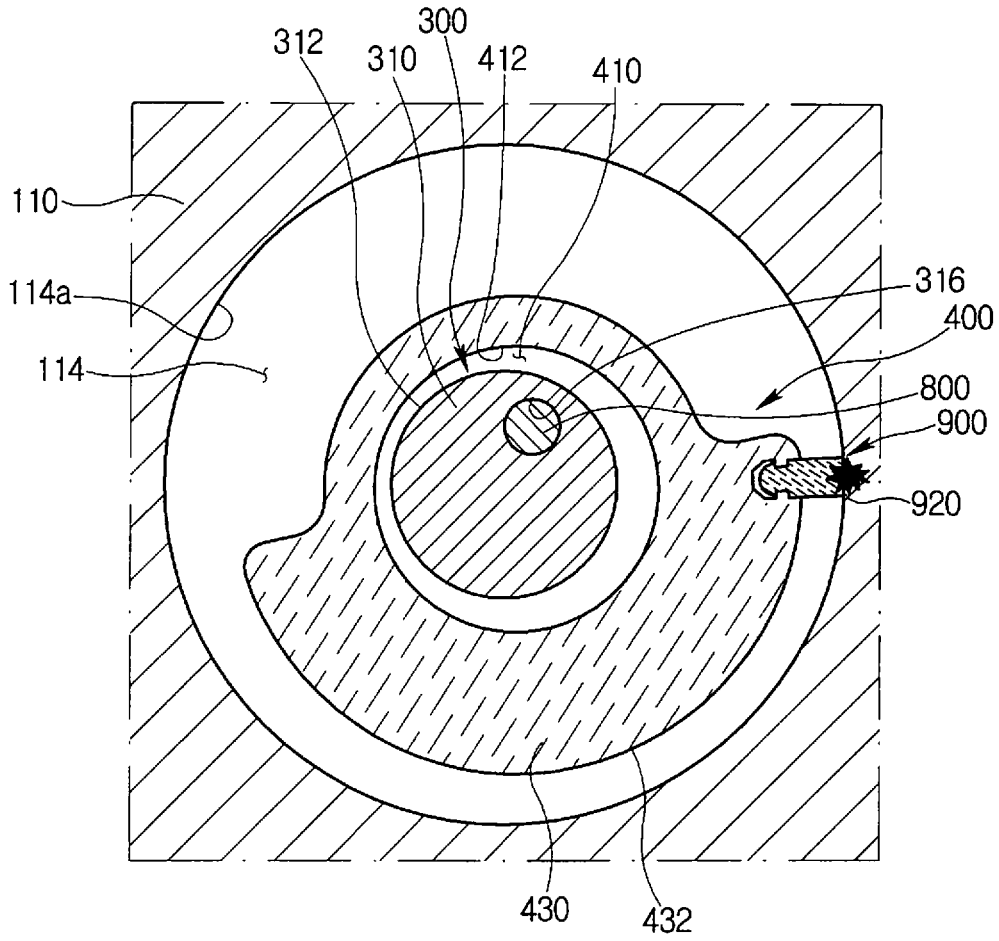
FIG. 15 is a cross-sectional diagram showing a state where the eccentric bush of FIG. 14 has been further rotated by the rotation clearance with respect to the shaft.

In this case, the operation effect can be almost the same as that of the above-described embodiment as shown in FIGS. 13 to 15.

However, in this case, it is possible to reduce the manufacturing cost consumed for forming the buffer member 900 and the weight of the scroll compressor.

Meanwhile, in an embodiment shown in FIGS. 12 to 15, the buffer member 900 of the protrusion shape can be formed on the first end portion or the second end portion of the balance weight 430, thereby adversely affecting the balancing of the rotation of the eccentric bush 400 in this case. Considering it, although not shown separately, the buffer member 900 of the protrusion shape can be formed in plural, and the plurality of buffer members 900 can be formed to be symmetrical to each other on the first end portion and the second end portion of the balance weight 430.

Meanwhile, In order for the buffer member fastening groove 434 and the one end portion of the buffer member 900 to be press-fitted and fastened to each other so that the buffer member 900 is prevented from being detached from the buffer member fastening groove 434, the buffer member fastening groove 434 and the one end portion of the buffer member 900 can be formed in a cylindrical shape, respectively, and the inner diameter of the buffer member fastening groove 434 can be formed smaller than the outer diameter of the one end portion of the buffer member 900.

However, in order to effectively prevent the buffer member 900 from being detached from the buffer member fastening groove 434 while the buffer member 900 is easily inserted into the buffer member fastening groove 434, as in an embodiment shown in FIGS. 12 to 15, an unevenness U can be preferably formed on at least one of the inner circumferential surface of the fastening groove and the outer circumferential surface of the one end portion of the buffer member 900 while the inner diameter of the buffer member fastening groove 434 is formed at the same level as the outer diameter of the one end portion of the buffer member 900.

Meanwhile, in an embodiment shown in FIGS. 12 to 15, the unevenness U is formed as a protrusion protruded from the inner circumferential surface of the buffer member fastening groove 434 and a groove formed to be engraved from the outer circumferential surface of the one end portion of the buffer member 900 and having the protrusion inserted therein, but is not limited thereto.

That is, for example, although not shown separately, the inner circumferential surface of the buffer member fastening groove 434 can be formed with a female screw, and the outer circumferential surface of the one end portion of the buffer member 900 can be formed with a male screw engaged to the female screw. In this case, the buffer member 900 can be easily replaced, and in addition, when the one end portion of the buffer member 900 is screw-coupled to the buffer member fastening groove 434, the gap G4 between the distal end surface 920 of the buffer member 900 and the inner circumferential surface 114*a* of the orbiting groove 114 can be adjusted according to the rotation degree of the buffer member 900 as needed.

What is claimed:

1. A scroll compressor, comprising:

a casing;

a shaft rotatably supported to the casing;

an eccentric bush having a recess part into which one end portion of the shaft is inserted, an eccentric part eccentric to the shaft, and a balance weight disposed at the opposite side of the eccentric part with respect to the recess part;

an orbiting scroll for performing the orbiting motion in interlock with the eccentric part; and a fixed scroll for forming a compression chamber together with the orbiting scroll, wherein the casing is formed with an orbiting groove in which the eccentric bush can perform the orbiting motion, wherein a buffer member is interposed between the orbiting groove and the balance weight, wherein the rotation clearance is formed to be present between the inner circumferential surface of the recess part and the outer circumferential surface of the one end portion of the shaft, and wherein the buffer member is formed to be compressed between the outer circumferential surface of the balance weight and the inner circumferential surface of the orbiting groove before the inner circumferential surface of the recess part and the outer circumferential surface of the one end portion of the shaft contact each other, and wherein the buffer member is mounted on the inner circumferential surface of the orbiting groove and formed to be contactable with the outer circumferential surface of the balance weight.

2. The scroll compressor of claim 1, wherein when the recess part is disposed at a position concentric with the one end portion of the shaft, a gap between the inner circumferential surface of the recess part and the outer circumferential surface of the one end portion of the shaft is constantly formed, and a gap between the outer circumferential surface of the balance weight and the inner circumferential surface of the orbiting groove is constantly formed, on any plane perpendicular to the one end portion of the shaft.

3. The scroll compressor of claim 2, wherein when the recess part is disposed at a position concentric with the one end portion of the shaft, a gap between the outer circumferential surface of the balance weight and the inner circumferential surface of the buffer member is constantly formed.

4. The scroll compressor of claim 3, wherein when the recess part is disposed at a position concentric with the one end portion of the shaft, the gap between the outer circumferential surface of the balance weight and the inner circumferential surface of the buffer member is formed narrower than the gap between the inner circumferential surface of the recess part and the outer circumferential surface of the one end portion of the shaft.

5. The scroll compressor of claim 4, wherein when the recess part is disposed at a position concentric with the one end portion of the shaft, the gap between the outer circumferential surface of the balance weight and the inner circumferential surface of the orbiting groove is formed to be equal to or wider than the gap between the inner circumferential surface of the recess part and the outer circumferential surface of the one end portion of the shaft.

6. The scroll compressor of claim 5, wherein the buffer member is made of a material having an elastic modulus smaller than those of the balance weight and the orbiting groove.

7. The scroll compressor of claim 1, wherein the buffer member is formed in an annular shape extending along the inner circumferential surface of the orbiting groove.

8. The scroll compressor of claim 1, wherein the axial direction of the orbiting groove is formed to be inclined with the gravitational direction, and wherein oil is stored in the lower portion in the gravitational direction of the orbiting groove.

* * * * *